United States Patent [19]

Bourgoin

[11] 4,320,600

[45] * Mar. 23, 1982

[54] SPRINKLING DEVICE FOR GRINDING WHEELS

[75] Inventor: Bernard Bourgoin, Saint Etienne, France

[73] Assignee: Centre Technique des Industries Mecaniques, Senlis, France

[ * ] Notice: The portion of the term of this patent subsequent to Dec. 4, 1996, has been disclaimed.

[21] Appl. No.: 132,612

[22] Filed: Mar. 21, 1980

[30] Foreign Application Priority Data

Jul. 19, 1979 [FR] France ..... 79 18670

[51] Int. Cl.[3] ..... B24B 55/02

[52] U.S. Cl. ..... 51/267

[58] Field of Search ..... 51/267, 266, 262 A

[56] References Cited

U.S. PATENT DOCUMENTS 3,256,647 6/1966 Hutton ..... 51/267

3,334,451 8/1967 Hutton ..... 51/267

3,616,577 11/1971 Hutton ..... 51/267

4,176,500 12/1979 Bourgoin ..... 51/267

*Primary Examiner*—Roscoe V. Parker

*Attorney, Agent, or Firm*—Holman & Stern

[57] ABSTRACT

An adjustable deflecting shoe which can be displaced towards or away from a grinding-wheel is formed by a series of blocks fixed in closely spaced relation on an elastically deformable arcuate strip which is displaceable between two cheeks of the shoe. The curvature of the deflecting surface is adjusted by means of supports for the central portion and the two end portions of the strip. The end supports are capable of displacement between the two cheeks both in the direction of a component parallel to the direction of adjustment and in the direction of a component at right angles to said direction, as well as angularly about an axis at right angles to the two directions aforesaid in response to suitable operating means.

4 Claims, 1 Drawing Figure

SPRINKLING DEVICE FOR GRINDING WHEELS

BRIEF SUMMARY OF THE INVENTION

This invention relates to sprinkling devices for grinding-wheels and like equipment, of the type comprising an arcuate deflecting shoe which is capable of displacement in a direction of adjustment for moving either towards or away from the grinding-wheel. The deflecting-shoe surface located opposite to the active surface of the grinding-wheel is provided with teeth or grooves oriented substantially at right angles to the direction of displacement of the active surface of the grinding-wheel in order to return the coolant or sprinkling fluid towards the grinding-wheel. A sprinkling device of the type under consideration further comprises means for adjusting the curvature of the deflecting surface of the shoe according to the diameter of the grinding-wheel.

Although the means employed for causing displacement of the deflecting shoe towards the grinding-wheel or in other words for adjusting the interval between the shoe and the active surface of the grinding-wheel often provide a satisfactory degree of precision in known devices of the type mentioned above as is the case, for example, with the device described in French Pat. No. 76-28 732, this no longer holds true in the case of empirical means of the type employed for adjusting the curvature of the deflecting surface of the shoe.

A primary objective to which current design trends are directed in modern machines of this type is to ensure that the configuration of the deflecting surface of the shoe conforms with a high degree of accuracy to the configuration of the active surface of the grinding-wheel. In other words, the width of the space between the deflecting shoe and the grinding wheel must be perfectly uniform over the entire length of the circular arc embraced by said shoe. Such a result is particularly desirable in fully automated numerical-control grinding machines, namely machines in which the program includes automatic wheel-dressing and diamond-cutting operations which have to be performed at the proper time.

The aim of the present invention is to provide a sprinkling device which satisfies these conditions and in which the shoe-adjusting means may if necessary be controlled automatically in response to information recorded in the program of the machine.

To this end and in accordance with the invention, the deflecting surface of the shoe is formed by a series of elementary surfaces forming part of rigid blocks fixed in closely spaced relation on an arcuate strip made of elastically deformable material and capable of displacement between two cheeks of the shoe. The means for adjusting the curvature of said deflecting surface comprise supports for the central portion and the two end portions of the elastically deformable strip. The supports provided for the two end portions of the strip are capable of displacement with respect to the shoe between the two cheeks of this latter, both in the direction of a component parallel to the direction of adjustment aforesaid and in the direction of a component at right angles to said direction, as well as angularly about an axis at right angles to the two directions aforesaid in response to suitable control means.

By virtue of this particular structure, it is possible not only to move the shoe towards the grinding-wheel at a suitable and strictly accurate distance from the wheel but also to ensure that the curvature of the deflecting surface of the shoe is precisely adapted to conform to the curvature of the grinding-wheel irrespective of the degree of wear of this latter.

A more complete understanding of the invention will be gained from the following description and from the accompanying drawings in which one embodiment of a grinding-wheel sprinkling device in accordance with the invention is shown by way of example, and in which:

DETAILED DESCRIPTION

Figure 1:
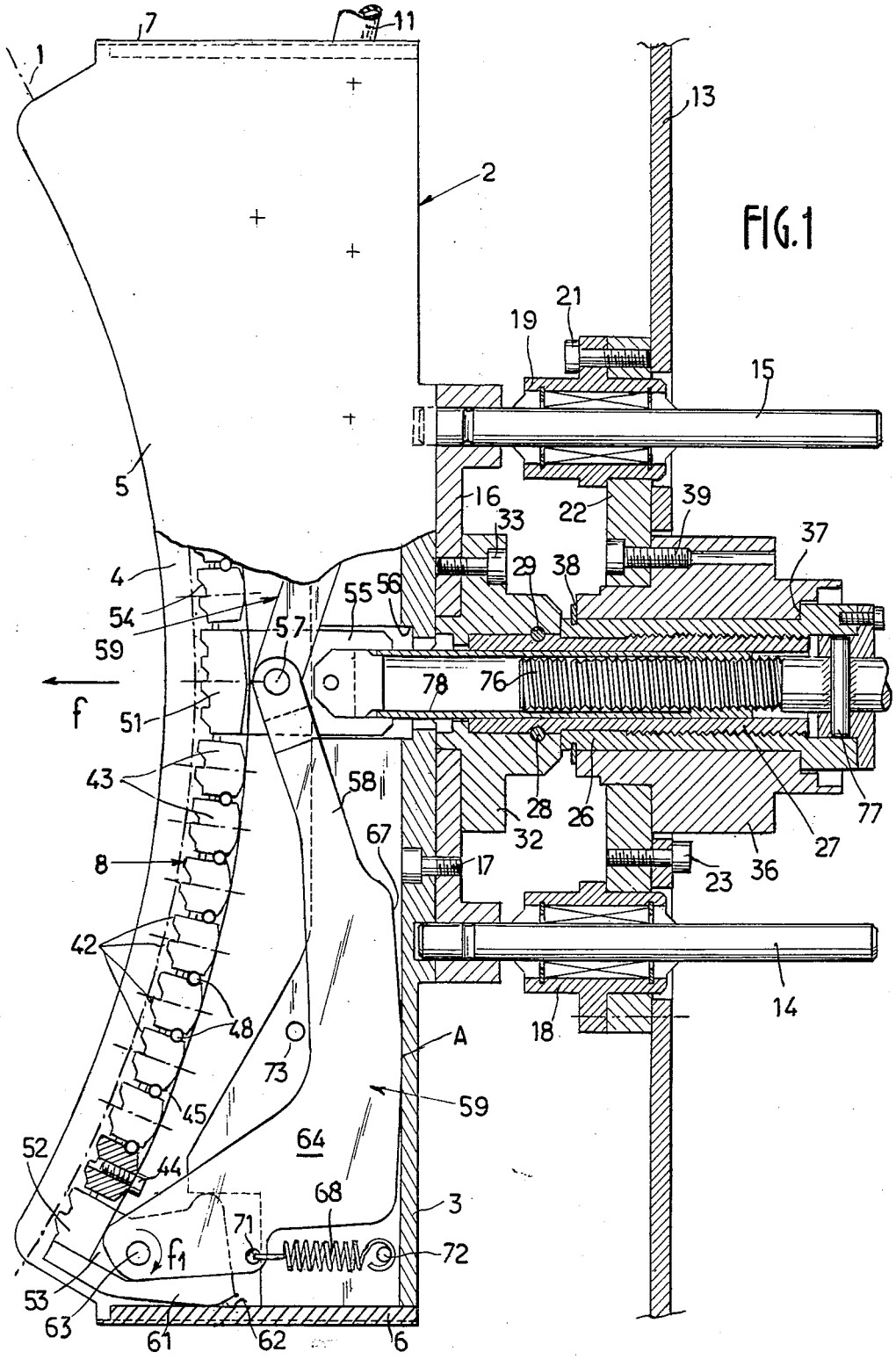
FIG. 1 is a partly cutaway view in cross-section of the device in side elevation.

The device illustrated in FIG. 1 is intended to carry out sprinkling of a cylindrical grinding-wheel, the periphery of which is designated by the reference numeral 1 but shown only partially in chain-dotted lines in FIG. 1.

Said device essentially consists of a hollow shoe generally designated by the reference numeral 2 and constituted by a bottom wall 3, by two side cheeks 4, 5, by two end walls 6, 7 and by a special deflecting surface which is designated by the reference numeral 8 and to which further reference will be made hereinafter. The sprinkling fluid is admitted into the shoe under pressure through a flexible hose 11.

The shoe 2 is supported by a casing 13 having a stationary position with respect to the grinding-wheel 1 by means of two rods 14, 15 which are rigidly fixed to the bottom wall 3 of the shoe by means of a plate 16 attached to said bottom wall by means of screws 17. Said rods 14, 15 are capable of sliding within guides 18, 19 attached to a counter-plate 22 by means of screws 21, said counter-plate being in turn attached to the casing 13 by means of screws 23.

The shoe 2 can be moved towards or away from the grinding-wheel 1 by means of displacements in a direction "f" or so-called "adjustment direction" by means of an adjustment control system comprising a screw designed in the form of an internally threaded rotatable sleeve 26 engaged with an externally threaded sleeve 27 which is rigidly fixed to a hub 32 by means of locking-pins 28, 29 between oppositely-facing walls, said hub 32 being in turn secured to the plate 16 by means of screws 33. The operating screw 26 is rotatably mounted within an outer sleeve 36 in which said screw is positioned axially in one direction by means of an annular shoulder 37 and in the other direction by means of a resilient snap-ring 38. The outer sleeve 36 is secured to the counter-plate 22 by means of screws 39.

The deflecting surface 8 of the shoe 2 is formed by a series of elementary surfaces 42 forming part of rigid blocks 43 fixed in closely spaced relation by means of screws 44 on an arcuate strip 45 of elastically deformable material such as stainless steel or bronze, for example. The length of each block 43 is substantially equal to the distance between the internal faces of the two side cheeks 4 and 5 of the shoe and this distance is in turn slightly greater than the width of the grinding-wheel 1. The strip 45 is provided with perforations opposite to the spaces between two successive blocks in order to allow the sprinkling fluid to pass from the interior of the shoe onto the active surface of the grinding-wheel 1. Furthermore, cylindrical cord elements 48 of elastomer which endow the deformable assembly with a certain degree of homogeneity are inserted in the spaces between two successive blocks; said cord elements are interrupted at the level of the sprinkling fluid passages or in other words are present only in the vicinity of the ends of the blocks. A central block 51 is fixed at the center of the deformable strip and an end block 52 is fixed at each end of said strip. All the blocks are provided with grooves 54 directed substantially at right angles to the direction of displacement of the active surface of the grinding-wheel 1 in order to return the sprinkling fluid towards the grinding-wheel.

The central block 51 is rigidly fixed to a support 55 which is constituted by an inward extension of said block and forms a central slide-block; this latter is slidably mounted within a central recess 56 of the shoe body which extends in the aforesaid direction of adjustment "f". The root of the extension 55 is adapted to carry a pin 57 on which is pivotally mounted the end of one of the two arms, namely the arm 58, of a bell-crank lever 59. Each end block 52 is rigidly fixed to a support 53 which also has an extension in the form of a cam 61, said cam being directed towards the interior of the shoe and slidably mounted within an end recess 62 of the shoe body which also extends in the direction of adjustment "f". The support 53 is adapted to carry a pin 63 on which is pivotally mounted the end of the other arm 64 of the bell-crank lever 59. The first arm 58 of the bell-crank lever is provided on its outer edge with a convex portion forming a cam 67. Said cam is elastically applied against the internal face of the bottom wall 3 of the shoe by means of a spring 68. One end of said spring is attached to a lug 71 which is fixed on the other arm 64 of the bell-crank lever. The other end of the spring 68 is attached to a stud 72 which is fixed on the shoe. A safety stud 73 which is also fixed on the shoe positively prevents the cam 67 from moving away from the bottom wall 3 of the shoe.

The central slide-block 55 can be displaced within the guiding recess 56 by means of an operating screw 76 which is rigidly fixed to the threaded sleeve 26 by means of a locking-pin 77 and which is engaged within another internally-threaded sleeve 78, said sleeve 78 being slidably mounted within the sleeve 27 and welded to the central slide-block 55. As will become apparent hereinafter, the operating system consisting of the screw 76 and the threaded sleeve or screw element 26 for controlling the forward displacement of the shoe constitutes a differential assembly for adjusting the curvature of the deflecting surface 8 of the shoe.

The operation of the device as a whole is as follows: it will be assumed by way of example that the two operating screws 26 and 76 have right-hand threads, the pitch of the screw-thread 26 being longer than the pitch of the screw 76. In order to ensure correct operation, the distance or spatial interval between the deflecting surface 8 of the shoe and the grinding-wheel 1 is within the range of 0.5 to 2 mm and can thus be 1 mm, for example. If the value of said interval becomes excessive after a certain degree of wear of the grinding-wheel, the correct value is restored by rotating the two rigidly coupled screws 26 and 76 in the anticlockwise direction. This movement of rotation gives rise on the one hand to a movement of outward displacement of the sleeve 27 such that the shoe assembly 2 is displaced towards the grinding-wheel 1 and on the other hand to a lesser forward displacement of the central slide-block 55 and of the central block 51. This results in a certain relative backward movement of the central slide-block 55 with respect to the shoe 2, thereby producing a pivotal movement of the bell-crank lever 59 about the (movable) point of contact "A" of the cam 67 with the bottom wall of the shoe. The pivot-pin 63 which is imprisoned in the arm 64 of the bell-crank lever undergoes a compound movement comprising a component parallel to the direction of adjustment "f" as well as a component in a direction at right angles to this latter and oriented towards the axis of the shoe. Said compound movement therefore has the effect of displacing the end block 52 towards the grinding-wheel to a greater extent than the central block 51. This is necessary in order to obtain a spatial interval of constant width in the "radial" direction by reason of the fact that the direction of adjustment "f" is not radial with respect to the grinding-wheel in the zone of the end block 52. Moreover, the component of the aforementioned movement towards the axis of the shoe has caused pivotal displacement, in the direction of the arrow "f1", of the extension 61 of the end block which is guided within the recess 62 in the direction "f". This has the effect of bringing back the elementary surface 42 of the end block 52 into parallel relation with that portion of the grinding-wheel surface which is located opposite to said block. As can readily be understood, the block located at the other end of the deformable strip 45 has been subjected to the same corrections of displacement and orientation. All the intermediate blocks carried by the same deformable strip as the central block 51 and the two end blocks 52 are now also in a correct position.

The assembly consisting of differential screws 26 and 76 for controlling the movement of approach of the shoe and the correction of curvature of the deflecting surface of said shoe can clearly be actuated by hand if necessary, this being performed by means of a crank or hand-wheel. However, said assembly can also be actuated by automatic means comprising, for example, a remote transmission system consisting of a chain or slotted drive belt, or else by means of an incorporated mechanism such as an electromagnetically controlled sawtooth escapement mechanism or by means of a jack operated by fluid under pressure. Irrespective of the type adopted, the power-driven operating unit can be subjected to automatic control by the grinding machine and to a numerical-control program, for example.

What is claimed is:

1. A sprinkling device for a grinding-wheel and like equipment, of the type having an arcuate, hollow deflecting shoe connected to a source of sprinkling fluid which is capable of displacement in a direction of adjustment "f" for moving either towards or away from the grinding-wheel, the deflecting-shoe surface located opposite to the active surface of the grinding-wheel being provided with teeth or grooves oriented substantially at right angles to the direction of displacement of the active surface of the grinding-wheel in order to return the coolant or sprinkling fluid towards the grinding-wheel, and means for adjusting the curvature of the deflecting surface of the shoe according to the diameter of the grinding-wheel, comprising the deflecting surface of the shoe being formed by a series of elementary surfaces forming part of rigid blocks fixed in closely spaced relation on an arcuate strip made of elastically deformable material and capable of displacement between two cheeks of the shoe, said means for adjusting the curvature of said deflecting surface of the shoe comprising supports for the central portion and the two end portions of the elastically deformable strip, the supports provided for the two end portions of said strip each comprising an end link member attached to the corresponding end block and pivotally connected through a lever member to the support for said central portion, said end link member being capable of displacement with respect to the shoe between two cheeks of said shoe both in the direction of a component parallel to said direction of adjustment and in the direction of a component at right angles to said direction, as well as angularly about an axis at right angles to said two directions in response to suitable control means.

2. A device according to claim 1, wherein said control means for controlling the movements of each of the two supports of the two end portions respectively of the elastically deformable strip comprise said lever being a bell-crank lever arranged so that the end of one arm of said lever is pivotally mounted on a central slide-block which is capable of moving on the shoe in said direction of adjustment under the action of said curvature adjustment means, said bell-crank lever arm being provided on the external edge thereof with a convex portion in the form of a cam resiliently applied against the bottom wall of the shoe which is opposite to the deflecting surface of said shoe, the end of the other arm of said bell-crank lever being connected to said end link member by a pivot-pin, said link member being provided beyond said pivot-pin with a cam which is mounted for sliding motion in said direction of adjustment within a guiding recess forming part of said shoe.

3. A device according to claim 2, wherein said support for the central portion of the elastically deformable strip comprises said central slideblock.

4. A device according to claim 1, wherein said means for adjusting the curvature of the deflecting surface of the shoe are operatively connected with operating means in the form of a differential screw mechanism for moving the shoe towards the grinding-wheel.

* * * * *